US008967260B2

(12) United States Patent
Kaminsky

(10) Patent No.: US 8,967,260 B2
(45) Date of Patent: Mar. 3, 2015

(54) SYSTEM AND METHOD FOR ENHANCING THE PRODUCTION OF HYDROCARBONS

(75) Inventor: Robert D. Kaminsky, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 487 days.

(21) Appl. No.: 13/320,195

(22) PCT Filed: May 13, 2010

(86) PCT No.: PCT/US2010/034749

§ 371 (c)(1), (2), (4) Date: Nov. 11, 2011

(87) PCT Pub. No.: WO2011/002557

PCT Pub. Date: Jan. 6, 2011

(65) Prior Publication Data

US 2012/0312537 A1 Dec. 13, 2012

Related U.S. Application Data

(60) Provisional application No. 61/222,790, filed on Jul. 2, 2009.

(51) Int. Cl.

| | |
|---|---|
| ***E21B 43/24*** | (2006.01) |
| ***E21B 43/00*** | (2006.01) |
| ***E21B 43/26*** | (2006.01) |
| ***E21B 43/30*** | (2006.01) |

(52) U.S. Cl.

CPC ..... *E21B 43/24* (2013.01); *E21B 43/2401* (2013.01); *E21B 43/006* (2013.01); *E21B 43/26* (2013.01); *E21B 43/305* (2013.01)

USPC ..... 166/302; 166/52; 166/60

(58) Field of Classification Search

CPC E21B 43/2405; E21B 43/2401; E21B 43/247

USPC ..... 166/302, 308.1, 52, 60

See application file for complete search history.

(56) References Cited

U.S. PATENT DOCUMENTS

| | | | |
|---|---|---|---|
| 849,524 | A | 4/1907 | Baker |
| 2,634,961 | A | 4/1953 | Ljungstrom |
| 2,732,195 | A | 1/1956 | Ljungstrom |
| 2,902,270 | A | 9/1959 | Salomonsson et al. |
| 3,095,031 | A | 6/1963 | Eurenius et al. |

(Continued)

FOREIGN PATENT DOCUMENTS

| | | |
|---|---|---|
| SE | 121737 | 4/1948 |

OTHER PUBLICATIONS

International Search Report for PCT/US2010/034749 dated Jul. 16, 2010.

*Primary Examiner* — Jennifer H Gay
*Assistant Examiner* — Steven MacDonald
(74) *Attorney, Agent, or Firm* — ExxonMobil Upstream Research Company—Law Department

(57) ABSTRACT

A method for enhancing hydrocarbon recovery from a reservoir using a heating well to reduce overburden stress over portions of the reservoir and the heating well is located in a subsurface formation proximate to the reservoir. The method may include heating the subsurface formation via the heating well above the reservoir, below the reservoir, or both, to form an expansion pillar and producing a hydrocarbon from the reservoir.

22 Claims, 3 Drawing Sheets

(56) References Cited

U.S. PATENT DOCUMENTS

| | | | | | |
|---|---|---|---|---|---|
| 3,127,936 | A | | 4/1964 | Eurenius | |
| 3,455,391 | A | | 7/1969 | Matthews et al. | |
| 3,522,846 | A | | 8/1970 | New | |
| 3,613,785 | A | | 10/1971 | Closmann | |
| 3,924,680 | A | | 12/1975 | Terry | |
| 4,140,179 | A | | 2/1979 | Kasevich et al. | |
| 4,705,108 | A | * | 11/1987 | Little et al. | 166/248 |
| 4,886,118 | A | | 12/1989 | Van Meurs et al. | |
| 5,147,111 | A | | 9/1992 | Montgomery | |
| 5,462,116 | A | | 10/1995 | Carroll | |
| 6,148,911 | A | | 11/2000 | Gipson et al. | |
| 6,745,837 | B2 | | 6/2004 | Wellington et al. | |
| 6,752,210 | B2 | | 6/2004 | De Rouffignac et al. | |
| 6,913,078 | B2 | | 7/2005 | Shahin, Jr. et al. | |
| 7,100,994 | B2 | | 9/2006 | Vinegar et al. | |
| 7,225,866 | B2 | | 6/2007 | Berchenko et al. | |
| 7,331,385 | B2 | | 2/2008 | Symington et al. | |
| 2003/0196788 | A1 | | 10/2003 | Vinegar et al. | |
| 2006/0065400 | A1 | | 3/2006 | Smith | |
| 2007/0045267 | A1 | | 3/2007 | Vinegar et al. | |
| 2007/0289736 | A1 | | 12/2007 | Kearl et al. | |
| 2008/0207970 | A1 | | 8/2008 | Meurer et al. | |

* cited by examiner

SYSTEM AND METHOD FOR ENHANCING THE PRODUCTION OF HYDROCARBONS

CROSS-REFERENCE TO RELATED APPLICATION

This application is the National Stage of International Application No. PCT/US2010/034749, filed 13 May 2010, which claims the benefit of U.S. Provisional Patent Application 61/222,790 filed 2 Jul. 2009 entitled SYSTEM AND METHOD FOR ENHANCING THE PRODUCTION OF HYDROCARBONS, the entirety of which is incorporated by reference herein.

FIELD

Exemplary embodiments of the present technology relate to a system and method for enhancing the production of hydrocarbons by enhancing the permeability of a reservoir.

BACKGROUND

This section is intended to introduce various aspects of the art, which may be associated with exemplary embodiments of the present technology. This discussion is believed to assist in providing a framework to facilitate a better understanding of particular aspects of the present technology. Accordingly, it should be understood that this section should be read in this light, and not necessarily as admissions of prior art.

Coal deposits may hold significant amounts of hydrocarbon gases, such as methane, ethane, and propane, generally adsorbed onto the surface of the coal. A significant amount of natural gas reserves exist as adsorbed species within coalbeds. The natural gas from coalbeds, commonly referred to as coalbed methane (CBM), currently constitutes a major source of the natural gas production in the United States. The CBM is generally produced by depressurization of coal seams. The gas content of coalbeds is dependent on the a number of factors—coal type, native pressure, and geologic history. Maximum gas adsorption increases with increasing pressure. Some coals at high pressures may have over about 300 standard cubic feet of adsorbed methane per ton of coal.

However, huge gas volumes are trapped in certain coalbeds that cannot be effectively produced with existing technology since the coalbeds do not have sufficient permeability to permit commercial production rates. The primary pathways for gas to flow through coalbeds are through natural fractures in the coal, which are called cleats. In certain coals, especially deep coals, the cleats may be essentially closed due to the overburden compression.

A common method to improve permeability of coalbeds is using cavitation (see, for example, U.S. Pat. No. 5,147,111). The process of cavitation involves a production well which is pressurized and then rapidly depressurized to cause a partial collapse of a formation, creating a hole proximate to the well. Cavitation may be performed using several cycles with flushing of the hole between each cycle to remove cave-in debris. Generally, cavitation may allow the cleat system in the coal to relax and partially expand into the void space. In this way, the permeability of the coal can be increased.

However, even using cavitation, only a small fraction of the CBM is economically recoverable. More specifically, depressurization is limited to relatively higher permeability coalbeds. This is because as pressure is decreased, the cleats may collapse and decrease the permeability of the coalbed. Loss of permeability is particularly a concern for deep coalbeds, which may have a low initial permeability. Depressurization may also result in production of low-pressure gas needing significant power for compression to permit pipelining to market.

Previous techniques have used heating of oil shale reservoirs to perform in-situ pyrolysis for enhancing the production of hydrocarbons (see, for example, U.S. Pat. Nos. 849,524; 2,634,961; 2,732,195; 2,902,270; 4,886,118; 6,745,837; 6,913,078; 7,331,385). Generally, to perform in-situ pyrolysis, a target region is heated above about 270° C.

U.S. Patent Application No. 2008/0207970 by Meurer, et al., discloses a method for produce products with improved properties by heating an organic-rich rock formation. The heating generally pyrolyzes at least a portion of the hydrocarbons in the formation (such as kerogen), converting these hydrocarbons to hydrocarbon fluids. The hydrocarbon fluids may then be produced from the formation.

U.S. Pat. No. 3,455,391 describes a process for horizontally fracturing an earth formation. The process tends to fracture the formation vertically by injecting hot fluid at high pressure until vertical fractures form and subsequently close due to thermal expansion. A fluid is then injected at a pressure sufficient to form horizontal fractures.

Further, U.S. Pat. No. 3,613,785 describes a process for horizontally fracturing a formation. Specifically, the process forms horizontal fractures in a subsurface earth formation which tends to fracture vertically at the naturally occurring formation temperature. The process includes the steps of extending at least one well borehole into the formation and generating a vertical fracture by pressurizing said borehole. A hot fluid is injected into at least one borehole to heat the formation and the injection of hot fluid is continued until thermal stressing of the formation matrix material causes the horizontal compressive stress in the formation to exceed the vertical compressive stress therein at a location selected for a second well. The borehole of the second well is extended into the formation, and the formation is hydraulically fractured through this second well borehole to form a horizontal fracture extending therefrom into the formation.

Neither of the patents described above applied the techniques disclosed to gas producing formations. Further, the use of heat to enhance hydrocarbon production when the pyrolysis of organic matter was not a key element of a production scheme, for example, heating outside of a reservoir, was not disclosed.

Other related material may be found in at least U.S. Pat. Nos. 3,095,031; 3,127,936; 4,140,179; and Swedish Patent 121,737.

SUMMARY

An exemplary embodiment of the present technology provides a method for enhancing hydrocarbon recovery from a reservoir using a heating well, the heating well being located in a subsurface formation proximate to the reservoir. A heat source may be placed into the heating well above the reservoir, below the reservoir, or both. The method may include heating the subsurface formation via the heating source to form an expansion pillar and producing a hydrocarbon from the reservoir. The heat source may be placed in the heating well vertically within 100 meters of the reservoir. The heat source may heat the subsurface formation to at least about 50° C. at a distance of 3 meters from the heat source or at least about 150° C. greater than the initial formation temperature over no more than 10% of the surface area of the reservoir. Fractures may be created in the subsurface formation in proximity to the reservoir via the expansion pillar. The heat sources may be placed within a substantially horizontal segment of the heating well. A production well may be constructed within or adjacent to the reservoir and at least a segment of the production well may be directionally drilled to follow the reservoir.

Another exemplary embodiment of the present technology provides a system for producing hydrocarbons from a reservoir. The system may include a heating well configured to apply heat to a layer of rock that is proximate to a reservoir, wherein the heat generates an expansion pillar in the subsurface formation above the reservoir, below the reservoir, or both. The system may also include a production well configured to produce a hydrocarbon from the reservoir. The heating well may include a heater placed above the reservoir, below the reservoir, or both. The heater may be electrically resistive heating elements, downhole burners, or any combinations thereof. Further, the heater may include electrically conductive propped fractures emanating from the heating well. The production well may include a section that is directionally drilled to follow the reservoir. The reservoir may be a coalbed containing adsorbed methane or a shale gas formation, among others.

Another exemplary embodiment of the present technology provides an energy production system that may include a heating well, configured to apply heat to a subsurface formation that is proximate to a coalbed, wherein the heat the heat is applied to the subsurface formation above the coalbed, below the coalbed, or both. The energy production system may also include a production well configured to produce CBM from the coalbed. A treatment facility may be configured to process the CBM. A compressor may be used to increase the pressure of the treated CBM for transportation by pipeline.

The treatment facility may include units configured to dewater the CBM, remove particulates from the CBM, remove sour gases from the CBM, or any combinations thereof. The energy production system may also include a surface burner, a downhole gas burner, a flameless distributed combustor, an electric resistance heater, an electrofrac heater, or any combinations thereof. A power generating station may be used to combust the CBM to generate steam, electrical power, or both.

DESCRIPTION OF THE DRAWINGS

The advantages of the present technology are better understood by referring to the following detailed description and the attached drawings, in which.

DETAILED DESCRIPTION

Figure 1:
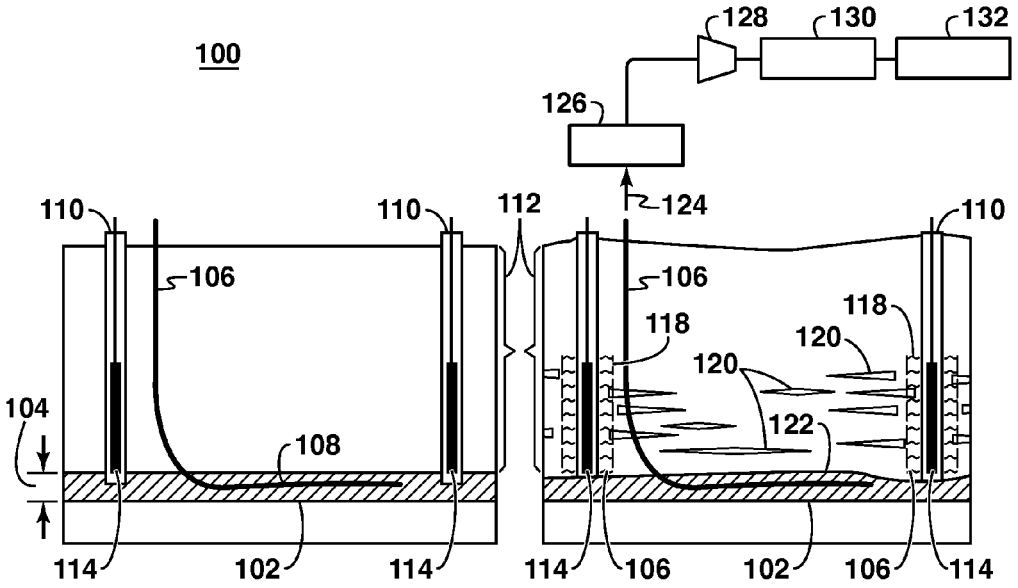
FIG. 1 is a cross-sectional view of a subsurface formation illustrating the use of heaters to enhance the production of hydrocarbons from a reservoir by lowering overburden stress, in accordance with an exemplary embodiment of the present technology.

In the following detailed description section, the specific embodiments of the present technology is described in connection with preferred embodiments. However, to the extent that the following description is specific to a particular embodiment or a particular use of the present technology, this is intended to be for exemplary purposes only and simply provides a description of the exemplary embodiments. Accordingly, the present technology is not limited to the specific embodiments described below, but rather, such technology includes all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present technology is not limited by the usage of the terms shown below, as all equivalents, synonyms, new developments, and terms or technology that serve the same or a similar purpose are considered to be within the scope of the present claims.

"Adsorbent material" means any material or combination of materials capable of adsorbing gaseous components. The adsorbent material discussed herein is a natural coal bed, as discussed further below.

"Adsorption" refers to a process, which may be reversible, whereby certain components of a mixture adhere to the surface of solid bodies that it contacts.

"Carbon number" refers to the number of carbon atoms in a molecule. Methane has a carbon number of 1, while ethane, propane and butane have carbon numbers of 2, 3, and 4, respectively. A hydrocarbon fluid may include various hydrocarbons with different carbon numbers. The hydrocarbon fluid may be described by a carbon number distribution. Carbon numbers or carbon number distributions may be determined by true boiling point distribution or gas-liquid chromatography.

"Cavitation completion" or "cavitation" is a process by which an opening may be made in a formation. Generally, cavitation is performed by drilling a well into a formation. The formation is then pressurized in the vicinity of the well. The pressure is suddenly released, causing the material in the vicinity of the well to fragment. The fragments and debris may then be swept to the surface through the well by circulating a fluid through the well.

"Coal" is generally a solid hydrocarbon, including, but not limited to, lignite, subbituminous, bituminous, anthracite, peat, and the like. The coal may be of any grade or rank. This can include, but is not limited to, low grade, high sulfur coal that is not suitable for use in coal-fired power generators due to the production of emissions having high sulfur content.

"CBM" (coalbed methane) is a natural gas that is adsorbed onto the surface of coal. CBM may be substantially comprised of methane, but may also include ethane, propane, and other hydrocarbons. Further, CBM may include some amount of other gases, such as carbon dioxide ($CO_2$) and nitrogen ($N_2$).

A "compressor" is a machine that increases the pressure of a gas by the application of work (compression). Accordingly, a low pressure gas (for example, 5 psig) may be compressed into a high-pressure gas (for example, 1000 psig) for transmission through a pipeline, injection into a well, or other processes.

"Dewatered" describes broadly any reduction of water content. Typically, a dewatered hydrocarbon-containing material can have a majority of the water removed or substantially removed, for example, less than about 5% by volume water or less than about 1% depending on the particular material and starting water content.

"Directional drilling" is the intentional deviation of the wellbore from the path it would naturally take. In other words, directional drilling is the steering of the drill string so that it travels in a desired direction. Directional drilling can be used for increasing the drainage of a particular well, for example, by forming deviated branch bores from a primary borehole. Directional drilling is also useful in the marine environment where a single offshore production platform can reach several hydrocarbon reservoirs by utilizing a plurality of deviated wells that can extend in any direction from the drilling platform. Directional drilling also enables horizontal drilling through a reservoir to form horizontal well bore. "Horizontal well bore" is used herein to mean the portion of a well bore in an unconsolidated subterranean producing zone to be completed which is substantially horizontal or at an angle from vertical in the range of from about 15° to about 75°. A horizontal well bore may have a longer section of the wellbore traversing the payzone of a reservoir, thereby permitting increases in the production rate from the well.

A "Facility" is tangible piece of physical equipment, or group of equipment units, through which hydrocarbon fluids are either produced from a reservoir or injected into a reservoir. In its broadest sense, the term facility is applied to any equipment that may be present along the flow path between a reservoir and its delivery outlets, which are the locations at which hydrocarbon fluids either leave the model (produced fluids) or enter the model (injected fluids). Facilities may comprise production wells, injection wells, well tubulars, wellhead equipment, gathering lines, manifolds, pumps, compressors, separators, surface flow lines and delivery outlets. In some instances, the term "surface facility" is used to distinguish those facilities other than wells.

"Formation" refers to any finite subsurface region. The formation may contain one or more hydrocarbon-containing layers (for example, a reservoir), one or more non-hydrocarbon containing layers, an overburden, or an underburden of any subsurface geologic formation.

"Fracture" is a crack or surface of breakage within rock not related to foliation or cleavage in metamorphic rock along which there has been no movement. A fracture along which there has been displacement is a fault. When walls of a fracture have moved only normal to each other, the fracture is called a joint. Fractures may enhance permeability of rocks greatly by connecting pores together, and for that reason, fractures are induced mechanically in some reservoirs in order to boost hydrocarbon flow. A "thermal fracture" refers to a fracture created in a formation caused directly or indirectly by expansion or contraction of a portion of the formation, which in turn is caused by increasing or decreasing the temperature of the formation. Thermal fractures may propagate into or form in neighboring regions significantly cooler than the heated zone.

"Heat source" is any system for providing heat to at least a portion of a formation substantially by conductive or radiative heat transfer. For example, a heat source may include electric heaters such as an insulated conductor, an elongated member, or a conductor disposed in a conduit. Other heating systems may include electric resistive heaters placed in wells, electrical induction heaters placed in wells, circulation of hot fluids through wells, resistively heated conductive propped fractures emanating from wells, downhole burners, and in situ combustion. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. For example, an "electrofrac heater" may use electrical conductive propped fractures to apply heat to the formation. In an electrofrac heater, a formation is hydraulically fractured and a graphite proppant is used to prop the fractures open. An electric current may then be passed through the graphite proppant causing it to generate heat, which heats the surrounding formation.

"Hydraulic fracturing" is used to create fractures that extend from the well bore into reservoir formations so as to stimulate the potential for production. A fracturing fluid, typically a viscous fluid, is injected into the formation with sufficient pressure to create and extend a fracture, and a proppant is used to "prop" or hold open the created fracture after the hydraulic pressure used to generate the fracture has been released. When pumping of the treatment fluid is finished, the fracture "closes". Loss of fluid to permeable rock results in a reduction in fracture width until the proppant supports the fracture faces. The fracture may be artificially held open by injection of a proppant material. Hydraulic fractures may be substantially horizontal in orientation, substantially vertical in orientation, or oriented along any other plane. Generally, the fractures tend to be vertical at greater depths, due to the increased pressure of the overburden.

"Hydrocarbon production" or refers to any activity associated with extracting hydrocarbons from a well or other opening. Hydrocarbon production normally refers to any activity conducted in or on the well after the well is completed. Accordingly, hydrocarbon production or extraction includes not only primary hydrocarbon extraction but also secondary and tertiary production technology, such as injection of gas or liquid for increasing drive pressure, mobilizing the hydrocarbon or treating by, for example chemicals or hydraulic fracturing the well bore to promote increased flow, well servicing, well logging, and other well and wellbore treatments.

"Hydrocarbons" are broadly defined as molecules formed primarily by carbon and hydrogen atoms. Hydrocarbons may also include other elements such as, but not limited to, halogens, metallic elements, nitrogen, oxygen, or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. As used herein, hydrocarbons generally indicate compounds that may be produced from a formation by pipeline, including gases or liquids.

"Natural gas" refers to various compositions of raw or treated hydrocarbon gases. Raw natural gas is primarily comprised of light hydrocarbons such as methane, ethane, propane, butanes, pentanes, hexanes and impurities like benzene, but may also contain small amounts of non-hydrocarbon impurities, such as nitrogen, hydrogen sulfide, carbon dioxide, and traces of helium, carbonyl sulfide, various mercaptans or water. Treated natural gas is primarily comprised of methane and ethane, but may also contain small percentages of heavier hydrocarbons, such as propane, butanes and pentanes, as well as small percentages of nitrogen and carbon dioxide.

"Overburden" refers to the subsurface formation overlying the formation containing one or more hydrocarbon-bearing zones (the reservoirs). For example, overburden may include rock, shale, mudstone, or wet/tight carbonate (such as an impermeable carbonate without hydrocarbons). An overburden may include a hydrocarbon-containing layer that is relatively impermeable. In some cases, the overburden may be permeable.

"Overburden stress" refers to the load per unit area or stress overlying an area or point of interest in the subsurface from the weight of the overlying sediments and fluids. In one or more embodiments, the "overburden stress" is the load per unit area or stress overlying the hydrocarbon-bearing zone that is being conditioned or produced according to the embodiments described. In general, the magnitude of the overburden stress will primarily depend on two factors: 1) the composition of the overlying sediments and fluids, and 2) the depth of the subsurface area or formation. Similarly, underburden refers to the subsurface formation underneath the formation containing one or more hydrocarbon-bearing zones (reservoirs). In the present application "Overburden pressure" generally means the same as "Overburden stress."

"Permeability" is the capacity of a rock to transmit fluids through the interconnected pore spaces of the rock. Permeability may be measured using Darcy's Law: $Q=(k\ \Delta P\ A)/(\mu L)$, where Q=flow rate ($cm^3/s$), $\Delta P$=pressure drop (atm) across a cylinder having a length L (cm) and a cross-sectional area A ($cm^2$), $\mu$=fluid viscosity (cp), and k=permeability (Darcy). The customary unit of measurement for permeability is the millidarcy. The term "relatively permeable" is defined, with respect to formations or portions thereof, as an average permeability of 10 millidarcy or more (for example, 10 or 100 millidarcy). The term "relatively low permeability" is defined, with respect to formations or portions thereof, as an average permeability of less than about 10 millidarcy. An impermeable layer generally has a permeability of less than about 0.1 millidarcy. For coals, permeability measurements are most meaningful over lengths significantly greater than the average distance between cleats so to be representative of macroscale flow. To achieve representative permeabilities pressure drop measurements may need to be taken over at least several inches to several feet. Coals with their cleat structure largely closed may have permeabilities of less than 1 millidarcy or even 0.1 millidarcy. On the other hand, coals with cleat structures largely open may have permeabilities of greater than 10 millidarcies or even 100 millidarcies. A "tight gas reservoir" is typically defined as a gas reservoir having a permeability of less than about 0.1 millidarcies.

"Porosity" is defined as the ratio of the volume of pore space to the total bulk volume of the material expressed in percent. Although there often is an apparent close relationship between porosity and permeability, because a highly porous rock may be highly permeable, there is no real relationship between the two; a rock with a high percentage of porosity may be very impermeable because of a lack of communication between the individual pores or because of capillary size of the pore space.

"Pressure" refers to a force acting on a unit area. Pressure is usually shown as pounds per square inch (psi). "Atmospheric pressure" refers to the local pressure of the air. Local atmospheric pressure is assumed to be 14.7 psia, the standard atmospheric pressure at sea level. "Absolute pressure" (psia) refers to the sum of the atmospheric pressure plus the gauge pressure (psig). "Gauge pressure" (psig) refers to the pressure measured by a gauge, which indicates only the pressure exceeding the local atmospheric pressure (a gauge pressure of 0 psig corresponds to an absolute pressure of 14.7 psia).

"Reservoir" or "reservoir formations" are typically pay zones (for example, hydrocarbon producing zones) that include sandstone, limestone, chalk, coal and some types of shale. Pay zones can vary in thickness from less than one foot (0.3048 m) to hundreds of feet (hundreds of m). The permeability of the reservoir formation provides the potential for production.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

"Thickness" of a layer refers to the distance between the upper and lower boundaries of a cross section of a layer, wherein the distance is measured normal to the average tilt of the cross section.

"Utilities" means (unless otherwise specified) anything consumed in a facility or process unit including any fluid (gas or liquid) required in order to operate the overall compressor or gas processing equipment of the facility or process unit. Some common examples of utilities can include electrical power, fuel gas, seal gas, instrument and control gas, nitrogen or inert gas, blanket gas, hydraulic fluids, pneumatic systems, water (including non-potable water), diesel or gasoline to run turbines or boilers or any other fluid required to run the equipment for a given process (for example, compression equipment).

"Wellbore" refers to a hole in the subsurface made by drilling or insertion of a conduit into the subsurface. A wellbore may have a substantially circular cross section, or other cross-sectional shapes (for example, circles, ovals, squares, rectangles, triangles, slits, or other regular or irregular shapes). The term "well", when referring to an opening in the formation, may be used interchangeably with the term "wellbore." A "well" or "wellbore" includes cased, cased and cemented, or open-hole wellbores, and may be any type of well, including, but not limited to, a production well, an experimental well, an exploratory well, a heating well, and the like. Wellbores may be vertical, horizontal, any angle between vertical and horizontal, diverted or non-diverted, and combinations thereof, for example a vertical well with a non-vertical segment.

The present technology provides systems and methods to enhance the flow of hydrocarbons from a reservoir by increasing the permeability of portions of the reservoir. More specifically, in exemplary embodiments of the present technology, the permeability may be increased by reducing the overburden stress over portions of the reservoir. This may be performed by using a heat source to heat nearby areas of the overburden or underburden. Thermal expansion in the vicinity of the heat source will cause the expanded hot zone to act as a pillar and lift up the overburden. Thus, compression loads below the pillar are increased whereas compression loads in the formation adjacent the pillar are decreased. In one exemplary embodiment of the present technology, a formation in proximity to a coalbed (for example, above the coalbed, below the coalbed, or both) may be heated to lower the overburden stress on the coal, allowing the cleat systems in the coal to open up, thus, increasing permeability and improving gas production.

FIG. 1 is a cross-sectional view of a subsurface formation 100 illustrating the use of heaters to enhance the production of hydrocarbons from a reservoir, such as a coalbed, by lowering overburden stress or pressure, in accordance with an exemplary embodiment of the present technology. As shown in FIG. 1, the reservoir 102 may include a coalbed, a shale gas formation, a tight gas formation, or other formations. The hydrocarbons produced may include CBM or other types of natural gas, gas liquids, shale oil, oil, or other hydrocarbon liquids. The reservoir 102 may often have a low thickness 104, for example, from a meter to a few tens of meters. However, the present technology is not limited to narrow formations, and may be used to reduce pressure on reservoirs 104 of any thickness.

In an exemplary embodiment of the present technology, a production well 106 having a horizontal section 108 may be drilled in the reservoir 102 to harvest the hydrocarbons that are present. Depending on the configuration of the reservoir 102, the production well 106 may be completely vertical, may have a horizontal section 108, or may have segments at any number of angles. For example, a production well 106 drilled into a coal bed that is at an angle to the surface may have an angled (or deviated) section configured to follow the coal bed.

Heating wells 110 may be drilled down to the reservoir 102 and located in the overburden 112 above the reservoir 102. Heaters 114 may be placed in the heating wells 110 in proximity to the layers of the overburden 112 over the reservoir. The heaters 114 may generally be located close to the reservoir 102, for example, within about 10 meters, 50 meters, or 100 meters of the top of the reservoir 102. As illustrated in FIG. 1, when the heaters 114 in the heating wells 110 are activated, the material 116 in the overburden 112 that is heated by the heaters 114 expands, forming pillars 118 of expanded material in proximity to the heaters 114. The pillars 118 may extend out from the heating wells 110, for example, 1 meter, 3 meters, 5 meters, or further, depending on the amount of energy applied to the heaters 114. The heaters are not limited to the heating wells 110, in other exemplary embodiments of the present technology, heat may be directly introduced into the overburden 112, such as by an electrofrac process extending out from the heating wells 110.

Local temperature increases near the heating wells 110 of 200° C., 400° C., or even 600° C. or more may be used to achieve thermal expansion of the overburden 112. Although these high temperatures may cause pyrolysis of hydrocarbons, in exemplary embodiments of the present technology, the pillars 118 are generally formed in rock containing minimal or sub-economic amounts of hydrocarbons. Any number of heat sources may be used to achieve these temperatures, as described herein.

Although the heating wells 110 are illustrated as vertical, any number of angled wells may be used, including horizontal wells, vertical wells, or deviated wells. Further, the heating wells 110 may contain multiple heaters 114, and may heat the underburden as well as the overburden 112, as discussed with respect to FIG. 3.

As the heat causes the pillars 118 to form, the cooler overburden 112 outside of the pillars 118, for example, further from the heating wells 110, may develop planar horizontal fractures 120. The weight (e.g. force or pressure) of the overburden 112 above the fractures 120 may not be transmitted to the region below the fractures 120. Accordingly, this may permit the reservoir 102 to expand in those areas, as indicated by reference numeral 122. The expansion of the reservoir 102 may increase the permeability of the reservoir 102, for example, by allowing cleats in a coalbed to expand. The increase in permeability may increase the amount of hydrocarbon 124 that may be harvested from the production wells 106. As hydrocarbon 124 is produced, the resulting decrease in material in the reservoir 102 may further increase the permeability, allowing for the deactivation of some, if not all, of the well heaters 114 over time. As an example, as CBM is harvested from a coalbed, the coal matrix will generally shrink, which may open up the cleat system.

In an exemplary embodiment of the present technology, a hydrocarbon 124 (such as CBM) is collected from the reservoir 102 (for example, a coalbed) using the technology described above. The hydrocarbon 124 may be treated in a treatment facility 126 to remove contaminants (such as particles, $H_2S$, and the like), water (such as by a dewatering device), or to separate natural gas liquids (materials with carbon numbers of 2 and higher), among others. After treatment, the resulting hydrocarbon (for example, natural gas) may be compressed, such as in a compressor system 128 and transported by a pipeline 130 to consumers 132 to be used as a fuel or feedstock. The hydrocarbon may be combusted in a local utility to generate steam or electricity in a power plant or may be directly provided to residential consumers. In other exemplary embodiments, the hydrocarbon is supplied to downstream facilities for further processing, such as refining or polymerization.

Figure 2:
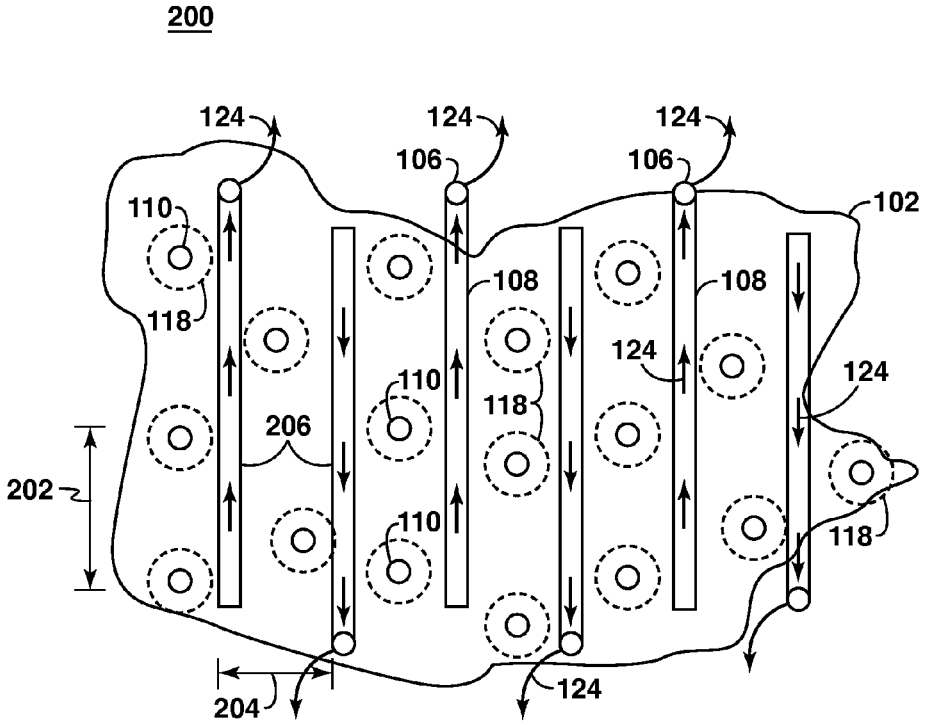
FIG. 2 is a top view of a reservoir, illustrating a matrix of production wells and heating wells, in accordance with an exemplary embodiment of the present technology.

FIG. 2 is a top view 200 of a reservoir 102, illustrating a matrix of production wells 106 and heating wells 110, in accordance with an exemplary embodiment of the present technology. The distance away from a heating well 110 at which compression loads are non-negligibly decreased increases with the stiffness (Young's modulus) of the rock. Therefore, reservoirs 102 that have stiff rocks in the surrounding underburden or overburden may require fewer heating wells 110 to lower the compression loading over the reservoir 102. In such reservoirs 102, the heated zones of the pillars 118 (for example, areas with a temperature greater than about 50° C. above the initial formation temperature) may include only a small portion of the reservoir (less than about 10%, 5%, 2%, or lower). For example, the separation 202 between heating wells 110 may be about 5 meters, 10 meters, 50 meters, 100 meters, 500 meters, or higher, depending on the stiffness of the rock. In an exemplary embodiment of the present technology, the heating wells 110 may be sufficiently close together to cause lifting of the overburden over a substantial portion of the reservoir 102. In another exemplary embodiment of the present technology, only a portion of the overburden over the reservoir 102 may be supported, as discussed with respect to FIG. 4.

Similarly, the separation 204 between the hydrocarbon collection segments 206 of the production wells 106 may be determined by the separation 202 between the pillars 118. Although the production wells 106 are shown in an alternating flow configuration in FIG. 2, they may be placed in any configuration useful for transferring the hydrocarbon 124 that is produced to a treatment facility for treatment and distribution.

Figure 3:
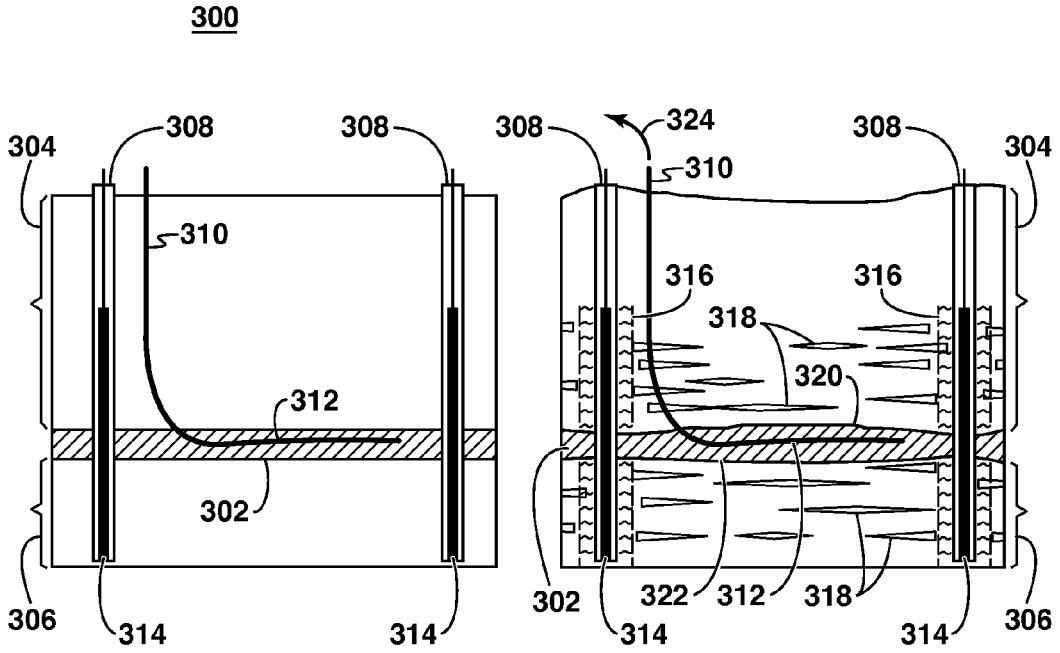
FIG. 3 is another cross-sectional view illustrating the use of heating a formation to enhance production of hydrocarbons from a reservoir by lowering the pressure of the overburden and the underburden, in accordance with an exemplary embodiment of the present technology.

FIG. 3 is another cross-sectional view illustrating the use of heating a formation 300 to enhance production of hydrocarbons from a reservoir 302 by lowering the pressure of the overburden 304 and the underburden 306, in accordance with an exemplary embodiment of the present technology. As shown in FIG. 3, a reservoir 302 is located between adjacent layers of rock that make up an overburden 304 and an underburden 306. In an exemplary embodiment of the present technology, heater wells 308 are drilled completely through the reservoir 302 and into the underburden 306. As previously described, a production well 310 may be drilled in the reservoir 302 and may have a section 312 that is directionally drilled to follow the reservoir 302. Heaters 314 may be inserted into the heating wells 308 in both the overburden 304 and the underburden 306.

As the heaters 314 heat the surrounding rock, pillars 316 of expanded rock form in both the overburden 304 and the underburden 306. This may lift the entire reservoir 302, allowing planar horizontal fractures 318 to form in both the overburden 304 and the underburden 306. The formation of the fractures 318 may relieve pressure on the reservoir 302 allowing it to relax both upwards 320 and downwards 322, which may further enhance the production of hydrocarbons 324. In the exemplary embodiments shown in FIGS. 1-3, the planar horizontal fractures formed when the pillars expand cover a substantial portion of the reservoirs 102, 302. However, the present technology is not limited to covering the entire reservoir 102, 302 with fractures.

Figure 4:
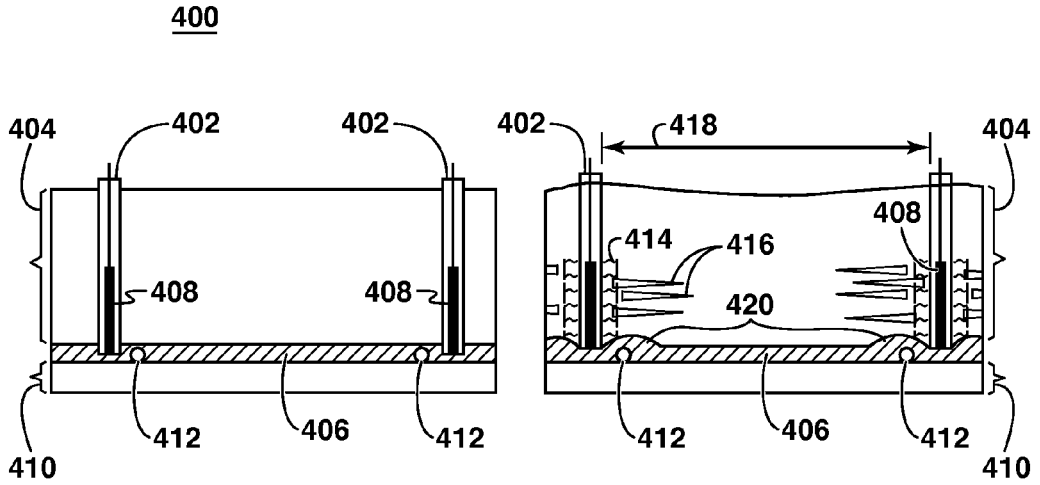
FIG. 4 is a cross-sectional view of a formation illustrating the use of widely spaced heating wells to enhance production of hydrocarbons in zones near the heating wells, in accordance with an exemplary embodiment of the present technology.

FIG. 4 is a cross-sectional view of a formation 400 illustrating the use of widely spaced heating wells 402 to enhance production of hydrocarbons in zones near the heating wells 402, in accordance with an exemplary embodiment of the present technology. As shown in FIG. 4, heating wells 402 are drilled through the overburden 404 over a reservoir 406. Heaters 408 may be inserted into the heating wells 402, for example, positioned to heat the layers of the overburden 404 that are above the reservoir 406. In other embodiments, the heaters 408 may be positioned to heat both the overburden 404 and the underburden 410. Production wells 412 (shown in cross-section in FIG. 4) may be directionally drilled through the reservoir 406, for example, to follow the reservoir 406.

Activation of the heaters 408 heats the surrounding rock, forming pillars 414 in the overburden 404. As discussed above, the expansion from the pillars 414 lifts the rock in the vicinity of the heating wells 402. The lifting causes the formation of planar horizontal fractures 416 in the overburden 404 above the reservoir 406, allowing the reservoir 406 to relax and expand, improving the permeability of the reservoir 406.

However, the spacing 418 between the heating wells 402 does not have to be small enough to form pillars 414 that completely fracture the overburden 404 between the heating wells 402 over the reservoir 406. As illustrated in FIG. 4, more widely spaced heating wells 402 (or heating wells 402 placed in softer rock), may cause expansion of the reservoir 406 in a more limited region 420, for example, over the production wells 402. This may increase production from a substantial portion of the reservoir 406, as the surface area for drainage to the production wells 412 has been increased. For example, the spacing 418 between heating wells 402 could be 1000 meters, 500 meters, 200 meters, 100 meters, or any other suitable spacing 418, as determined by the desired increase in hydrocarbon production, the hardness of the rock in the overburden 404, and the cost of drilling and operating the heating wells 402.

Figure 5:
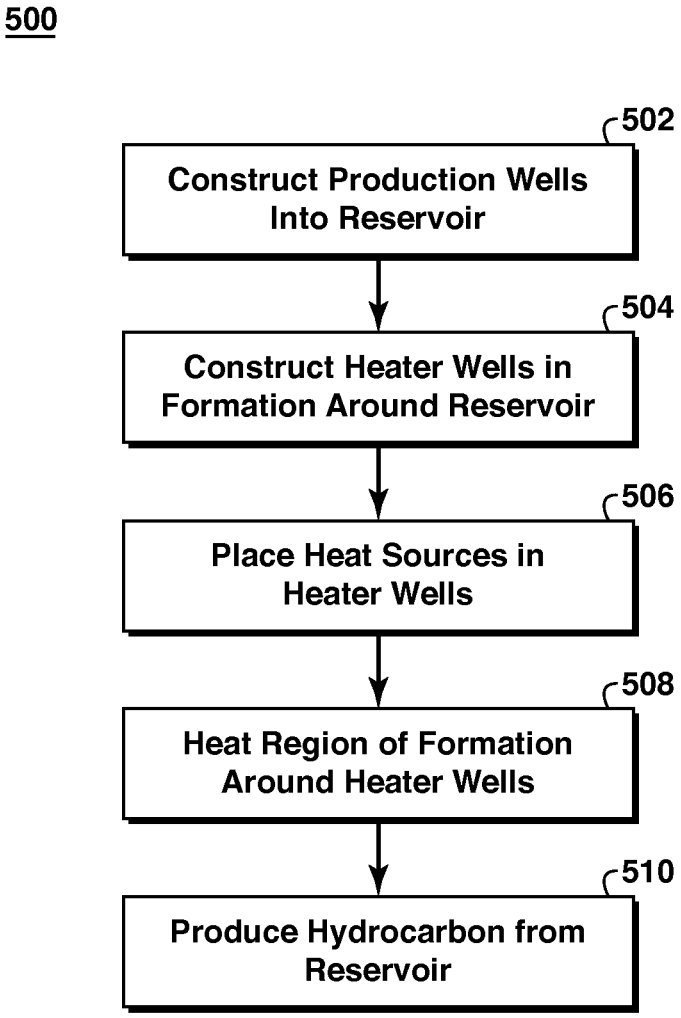
FIG. 5 is a process flow diagram showing a method for enhancing hydrocarbon recovery from a reservoir, in accordance with an exemplary embodiment of the present technology.

FIG. 5 is a process flow diagram showing a method for enhancing hydrocarbon recovery from a reservoir, in accordance with an exemplary embodiment of the present technology. The method 500 includes the construction of production wells into a hydrocarbon reservoir, as indicated at block 502. As discussed above, the production wells may be directionally drilled to follow the reservoir. At block 504, heater wells are constructed into the formation around the reservoir. In exemplary embodiments of the present technology, the production wells may be located in close proximity to the heater wells. Heat sources may be placed into the heater wells, as indicated at block 506, where the heat sources are located proximate to the reservoir, for example, in the overburden, the underburden, or both. The heat sources may be activated to heat the formation around the heater wells, as indicated at block 508. Heating the formation around the heater wells may form pillars of expanded rock that lower the pressure of the overburden or underburden on the reservoir, allowing the permeability of the formation to increase. For example, in a coalbed, lowering the pressure on the coal may allow natural cleats in the coal to open, increasing the permeability. At block 510, a hydrocarbon may be produced from the reservoir at higher amounts than may have been possible in the absence of the heated pillars. The hydrocarbon may include CBM, or other natural gases, natural gas liquids, or liquid hydrocarbons.

While the present technology may be susceptible to various modifications and alternative forms, the exemplary embodiments discussed above have been shown only by way of example. However, it should again be understood that the present technology is not intended to be limited to the particular embodiments disclosed herein. Indeed, the present technology includes all alternatives, modifications, and equivalents falling within the true spirit and scope of the appended claims.

What is claimed is:

1. A method for enhancing hydrocarbon recovery from a reservoir using a heating well, the method comprising:

placing a heat source into the heating well above and proximate to the reservoir, below and proximate to the reservoir, or both;

heating the subsurface formation proximate to the reservoir via the heating source by applying heat from the heat source in the heating well only outside of the reservoir to form an expansion pillar in the subsurface formation proximate to the reservoir; and producing a hydrocarbon from the reservoir.

2. The method of claim 1, comprising placing the heat source vertically within 100 meters of the reservoir.

3. The method of claim 1, wherein the heat source heats the subsurface formation to at least 50° C. greater than the initial formation temperature at a distance of 3 meters from the heat source.

4. The method of claim 1, wherein less than about 10% of the reservoir is heated to greater than about 50° C. above the initial formation temperature.

5. The method of claim 1, wherein less than about 10% of the reservoir is heated to greater than about 150° C. above the initial formation temperature.

6. The method of claim 1, comprising:

creating fractures in the subsurface formation in above or below the reservoir via the expansion pillars such that the reservoir expands to increase a permeability of the reservoir.

7. The method of claim 1, comprising:

placing the heat source within a substantially horizontal segment of the heated well.

8. The method of claim 1, comprising:

constructing a production of the well within or adjacent to the reservoir.

9. The method of claim 8, comprising:

directionally drilling a segment of the production well to follow the reservoir.

10. The method of claim 1 wherein the heating is applied only to formations outside the reservoir.

11. A system for producing hydrocarbons from a reservoir, comprising:

a heating well, configured to apply heat to a subsurface formation that is proximate to a reservoir by applying heat from the heating well only outside of the reservoir, wherein the heat generates an expansion pillar in the subsurface formation above and proximate to the reservoir, below and proximate to the reservoir, or both; and a production well configured to produce a hydrocarbon from the reservoir proximate to the expansion pillar.

12. The system of claim 11, comprising:

a heater disposed in the heating well above the reservoir, below the reservoir, or both.

13. The system of claim 12, wherein the heater comprises electrically resistive heating elements, downhole burners, or any combination thereof.

14. The system of claim 12, wherein the heater comprises electrically conductive propped fractures emanating from the heating well.

15. The system of claim 11, wherein the production well comprises a section that is directionally drilled to follow the reservoir.

16. The system of claim 11, wherein the reservoir is a coalbed containing adsorbed methane.

17. The system of claim 11, wherein the reservoir is a shale gas formation.

18. The system of claim 11, wherein the expansion pillar is configured to fracture the subsurface formation above the reservoir to relieve overburden forces on the reservoir sufficient to permit at least a portion of the reservoir to expand.

19. An energy production system, comprising:

a heating well, configured to apply heat and thermal expansion to a subsurface formation that is proximate to a coalbed, wherein the heat is applied from the heating well only to the subsurface formation that is outside the coalbed, causing the subsurface formation to thermally expand; and a production well configured to produce coalbed methane (CBM) from the coalbed.

20. The energy production system of claim 19, comprising:

a treatment facility configured to process the CBM; and a compressor configured to increase the pressure of the treated CBM for transportation by pipeline.

21. The energy production system of claim 20, wherein the treatment facility comprises units configured to dewater the CBM, remove particulates from the CBM, remove sour gas from the CBM, or any combinations thereof.

22. The energy production system of claim 19, comprising a surface burner, a downhole gas burner, a flameless distributed combustor, an electric resistance heater, an electrofrac heater, or any combinations thereof.

* * * * *